US011341911B2

(12) United States Patent
Qu et al.

(10) Patent No.: US 11,341,911 B2
(45) Date of Patent: May 24, 2022

(54) PIXEL CIRCUIT, DRIVING METHOD THEREOF AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Jiawei Qu, Beijing (CN); Linxuan Li, Beijing (CN); Taoran Zhang, Beijing (CN); Wenjun Liao, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 608 days.

(21) Appl. No.: 16/323,435

(22) PCT Filed: Apr. 20, 2018

(86) PCT No.: PCT/CN2018/083941
§ 371 (c)(1),
(2) Date: Feb. 5, 2019

(87) PCT Pub. No.: WO2019/041835
PCT Pub. Date: Mar. 7, 2019

(65) Prior Publication Data

US 2021/0335246 A1 Oct. 28, 2021

(30) Foreign Application Priority Data

Aug. 31, 2017 (CN) ..... 201710773986.X

(51) Int. Cl.
*G09G 3/3241* (2016.01)
*G09G 3/3283* (2016.01)

(52) U.S. Cl.
CPC ..... *G09G 3/3241* (2013.01); *G09G 3/3283* (2013.01); *G09G 2300/0426* (2013.01); *G09G 2310/0272* (2013.01)

(58) Field of Classification Search
CPC ..... G09G 3/3241; G09G 3/3283; G09G 2310/0272; G09G 2300/0426
See application file for complete search history.

(56) References Cited

U.S. PATENT DOCUMENTS

2003/0227262 A1* 12/2003 Kwon ..... G09G 3/325 315/169.3
2004/0036457 A1 2/2004 Tokioka et al.
(Continued)

FOREIGN PATENT DOCUMENTS

CN 1469337 A 1/2004
CN 1567409 A 1/2005
(Continued)

OTHER PUBLICATIONS

International Search Report and Written Opinion for Application No. PCT/CN2018/083941, dated Jul. 5, 2018, 12 Pages.

*Primary Examiner* — Md Saiful A Siddiqui
(74) *Attorney, Agent, or Firm* — Brooks Kushman P.C.

(57) ABSTRACT

A pixel circuit includes a storage capacitor unit, a driving transistor, a compensation unit, a switching unit, a light-emitting element and a current supply unit. The compensation unit is connected to a compensation control end, a gate electrode and a second electrode of the driving transistor, and the current supply unit, and configured to, under the control of the compensation control end, control the current supply unit to be electrically connected to, or electrically disconnected from, the gate electrode, and control the gate electrode to be electrically connected to, or electrically disconnected from, the second electrode. The switching unit is connected to a light-emitting control end, the second
(Continued)

electrode, and a first end of the light-emitting element, and configured to control the second electrode to be electrically connected to, or electrically disconnected from, the first end of the light-emitting element under the control of the light-emitting control end.

5 Claims, 2 Drawing Sheets

(56) References Cited

U.S. PATENT DOCUMENTS

| | | | | |
|---|---|---|---|---|
| 2004/0251844 | A1 | 12/2004 | Hashido et al. | |
| 2005/0099412 | A1* | 5/2005 | Kasai | G09G 3/325 345/204 |
| 2007/0268217 | A1* | 11/2007 | Ahn | G09G 3/325 345/76 |
| 2007/0268220 | A1* | 11/2007 | Lee | G09G 3/3241 345/76 |
| 2010/0039458 | A1 | 2/2010 | Nathan et al. | |
| 2013/0038589 | A1 | 2/2013 | Tseng et al. | |
| 2016/0240136 | A1 | 8/2016 | Han | |

FOREIGN PATENT DOCUMENTS

| | | | |
|---|---|---|---|
| CN | 1573876 | A | 2/2005 |
| CN | 102057418 | A | 5/2011 |
| CN | 103996379 | A | 8/2014 |
| CN | 107369410 | A | 11/2017 |
| CN | 207097426 | U | 3/2018 |

* cited by examiner

PIXEL CIRCUIT, DRIVING METHOD THEREOF AND DISPLAY DEVICE

CROSS-REFERENCE TO RELATED APPLICATION APPLICATIONS

This application is the U.S. national phase of PCT Application No. PCT/CN2018/083941 filed on Apr. 20, 2018, which claims priority to Chinese Patent Application No. 201710773986.X filed on Aug. 31, 2017, which are incorporated herein by reference in their entireties.

TECHNICAL FIELD

The present disclosure relates to the field of display technology, in particular to a pixel circuit, a driving method thereof and a display device.

BACKGROUND

Usually, a voltage compensation technology is adopted by a conventional pixel circuit, and it is impossible for a pixel circuit having a small amount of transistors to compensate for an IR drop (the IR drop refers to such a phenomenon where a voltage across a power source and the ground in an integrated circuit (IC) decreases or increases). Although it is able to compensate for a threshold voltage of a driving transistor as well as the IR drop by using a pixel circuit having a large amount of transistors, the pixel circuit has a relatively complex structure. In addition, when the threshold voltage of the driving transistor and the IR drop are compensated through a conventional pixel circuit using a current compensation technology, a complex circuit structure needs to be adopted, and meanwhile the circuit performance is instable.

SUMMARY

The present disclosure provides in some embodiments a pixel circuit, including a storage capacitor unit, a driving transistor, a compensation unit, a switching unit, a light-emitting element and a current supply unit configured to supply a data current. A first end of the storage capacitor unit is connected to a gate electrode of the driving transistor, and a second end of the storage capacitor unit is connected to a first voltage input end. A first electrode of the driving transistor is connected to the first voltage input end. The compensation unit is connected to a compensation control end, the gate electrode and a second electrode of the driving transistor, and the current supply unit, and configured to, under the control of the compensation control end, control the current supply unit to be electrically connected to, or electrically disconnected from, the gate electrode of the driving transistor, and control the gate electrode of the driving transistor to be electrically connected to, or electrically disconnected from, the second electrode of the driving transistor. The switching unit is connected to a light-emitting control end, the second electrode of the driving transistor and a first end of the light-emitting element, and configured to control the second electrode of the driving transistor to be electrically connected to, or electrically disconnected from, the first end of the light-emitting element under the control of the light-emitting control end. A second end of the light-emitting element is connected to a second voltage input end.

In a possible embodiment of the present disclosure, the driving transistor is a p-type transistor, the first voltage input end is a high voltage input end, and the second voltage input end is a low voltage input end; or the driving transistor is an n-type transistor, the first voltage input end is a low voltage input end, and the second voltage input end is a high voltage input end.

In a possible embodiment of the present disclosure, the compensation unit includes: a first compensation transistor, a gate electrode of which is connected to the compensation control end, a first electrode of which is connected to the gate electrode of the driving transistor, and a second electrode of which is connected to the current supply unit; and a second compensation transistor, a gate electrode of which is connected to the compensation control end, a first electrode of which is connected to the second electrode of the driving transistor, and a second electrode of which is connected to the gate electrode of the driving transistor.

In a possible embodiment of the present disclosure, the first compensation transistor and the second compensation transistor are n-type transistors, or p-type transistors.

In a possible embodiment of the present disclosure, the switching unit includes a switching transistor, a gate electrode of which is connected to the light-emitting control end, a first electrode of which is connected to the second electrode of the driving transistor, and a second electrode of which is connected to the first end of the light-emitting element.

In a possible embodiment of the present disclosure, the switching transistor is an n-type or a p-type transistor.

In a possible embodiment of the present disclosure, the storage capacitor unit includes a storage capacitor, a first end of which is connected to the gate electrode of the driving transistor, and a second end of which is connected to the first voltage input end.

In a possible embodiment of the present disclosure, the light-emitting element includes an organic light-emitting diode (OLED). The driving transistor is a p-type transistor, the first end of the light-emitting element is an anode of the OLED, and the second end of the light-emitting element is a cathode of the OLED; or the driving transistor is an n-type transistor, the first end of the light-emitting element is a cathode of the OLED, and the second end of the light-emitting element is an anode of the OLED.

In a possible embodiment of the present disclosure, the light-emitting element includes an OLED, the current supply unit is a power supply, the first voltage input end is a high voltage input end for inputting a high voltage, and the second voltage input end is a low voltage input end for inputting a low voltage. The compensation unit includes: a first compensation transistor, a gate electrode of which is connected to the compensation control end, a source electrode of which is connected to the gate electrode of the driving transistor, and a drain electrode of which is connected to a current source for supplying the data current; and a second compensation transistor, a gate electrode of which is connected to the compensation control end, a source electrode of which is connected to a drain electrode of the driving transistor, and a drain electrode of which is connected to the gate electrode of the driving transistor. The switching unit includes a switching transistor, a gate electrode of which is connected to the light-emitting control end, a source electrode of which is connected to the drain electrode of the driving transistor, and a drain electrode of which is connected to the anode of the OLED. The switching transistor, the driving transistor, the first compensation transistor and the second compensation transistor are all p-type transistors.

In a possible embodiment of the present disclosure, the light-emitting element includes an OLED, the current supply unit is a current source, the first voltage input end is a low voltage input end for inputting a low voltage, and the second voltage input end is a high voltage input end for inputting a high voltage. The compensation unit includes: a first compensation transistor, a gate electrode of which is connected to the compensation control end, a source electrode of which is connected to the gate electrode of the driving transistor, and a drain electrode of which is connected to the current source; and a second compensation transistor, a gate electrode of which is connected to the compensation control end, a source electrode of which is connected to the drain electrode of the driving transistor, and a drain electrode of which is connected to the gate electrode of the driving transistor. The switching unit includes a switching transistor, a gate electrode of which is connected to the light-emitting control end, a source electrode of which is connected to the drain electrode of the driving transistor, and a drain electrode of which is connected to a cathode of the OLED. The switching transistor, the driving transistor, the first compensation transistor and the second compensation transistor are all n-type transistors.

In another aspect, the present disclosure provides in some embodiments a method for driving the above-mentioned pixel circuit, including: at a compensation stage of each display period, controlling, by the switching unit, the second electrode of the driving transistor to be electrically disconnected from the first end of the light-emitting element under the control of the light-emitting control end, controlling, by the compensation unit, the current supply unit to supply a data current $I_{data}$ to the gate electrode and the second electrode of the driving transistor under the control of the compensation control end, so as to enable the driving transistor to operate in a saturated state, enable a driving current of the driving transistor to be equal to the data current Lam, and set a potential at the gate electrode of the driving transistor to be a resetting voltage; and at a light-emitting stage of each display period, controlling, by the switching unit, the second electrode of the driving transistor to be electrically connected to the first end of the light-emitting element under the control of the light-emitting control end, and controlling, by the compensation unit, the current supply unit to be electrically disconnected from the second electrode of the driving transistor under the control of the compensation control end, so as to maintain a potential at the gate electrode of the driving transistor as the resetting voltage, thereby to control the driving transistor to operate in a saturated state and enable the driving current of the driving transistor to be equal to the data current $I_{data}$.

In a possible embodiment of the present disclosure, the driving transistor is a p-type transistor and the first voltage input end is a high voltage input end for inputting a high voltage VDD, the resetting voltage is equal to $VDD+V_{th}-\sqrt{I_{data}/K}$, where Vth represents a threshold voltage of the driving transistor, and K represents a current coefficient of the driving transistor.

In a possible embodiment of the present disclosure, the driving transistor is an n-type transistor and the first voltage input end is a low voltage input end for inputting a low voltage VSS, the resetting voltage is equal to $VSS+V_{th}+\sqrt{I_{data}/K}$, wherein Vth represents a threshold voltage of the driving transistor, and K represents a current coefficient of the driving transistor.

In a possible embodiment of the present disclosure, the method further includes, at the compensation stage: controlling, by the switching unit, the second electrode of the driving transistor to be electrically disconnected from the first end of the light-emitting element under the control of the light-emitting control end; and after the elapse of a predetermined time period, controlling, by the compensation unit, the current supply unit to supply the data current $I_{data}$ to the gate electrode and the second electrode of the driving transistor under the control of the compensation control end.

In a possible embodiment of the present disclosure, at the compensation stage, a high level signal is outputted by the light-emitting control end, a low level signal is outputted by the compensation control end, a rising edge of the signal from the light-emitting control end is spaced apart from a falling edge of the signal from the compensation control end by the predetermined time period; or a low level signal is outputted from the light-emitting control end, a high level signal is outputted by the compensation control end, and a falling edge of the signal from the light-emitting control end is spaced apart from a rising edge of the signal from the compensation control end by the predetermined time period.

In yet another aspect, the present disclosure provides in some embodiments a display device including the above-mentioned pixel circuit.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

An object of the present disclosure is to provide a pixel circuit, a driving method thereof and a display device, so as to solve the problem in the related art where a complex circuit structure is adopted and the circuit performance is instable when a threshold voltage of a driving transistor and an IR-drop are compensated through a conventional pixel circuit.

All transistors adopted in the embodiments of the present disclosure may be thin film transistors (TFTs), field effect transistors (FETs) or any other elements having similar characteristics. In order to differentiate two electrodes other than a gate electrode from each other, one of the two electrodes is called as first electrode and the other is called as second electrode. In actual use, the first electrode may be a drain electrode while the second electrode may be a source electrode, or the first electrode may be a source electrode while the second electrode may be a drain electrode.

Figure 1:
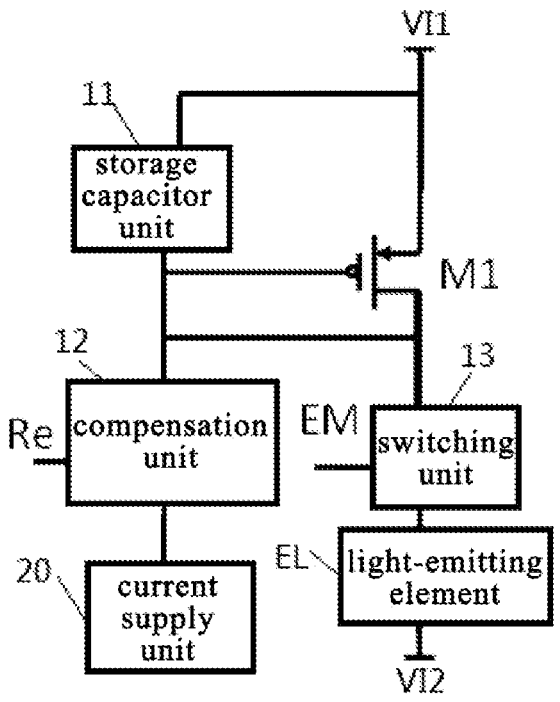
FIG. 1 is a schematic view showing a pixel circuit according to some embodiments of the present disclosure.

The present disclosure provides in some embodiments a pixel circuit which, as shown in FIG. 1, includes a storage capacitor unit 11, a driving transistor M1, a compensation unit 12, a switching unit 13, a light-emitting element EL and a current supply unit 20 configured to supply a data current. A first end of the storage capacitor unit 11 is connected to a gate electrode of the driving transistor M1, and a second end of the storage capacitor unit 11 is connected to a first voltage input end VI1. A first electrode of the driving transistor M1 is connected to the first voltage input end VI1. The compensation unit 12 is connected to a compensation control end Re, the gate electrode and a second electrode of the driving transistor M1, and the current supply unit 20, and configured to, under the control of the compensation control end Re, control the current supply unit 20 to be electrically connected to, or electrically disconnected from, the gate electrode of the driving transistor M1, and control the gate electrode of the driving transistor M1 to be electrically connected to, or electrically disconnected from, the second electrode of the driving transistor M1. The switching unit 13 is connected to a light-emitting control end EM, the second electrode of the driving transistor M1 and a first end of the light-emitting element EL, and configured to control the second electrode of the driving transistor M1 to be electrically connected to, or electrically disconnected from, the first end of the light-emitting element EL under the control of the light-emitting control end EM. A second end of the light-emitting element EL is connected to a second voltage input end VI2.

In FIG. 1, the driving transistor M1 is a p-type transistor. However, in actual use, the driving transistor M1 may also be an n-type transistor, i.e., a type of the driving transistor M1 will not be particularly defined herein.

According to the pixel circuit in the embodiments of the present disclosure, the compensation unit 12 may control, under the control of the compensation control end Re, whether the current supply unit 20 provides the data current to the gate electrode and the second electrode of the driving transistor M1. In this way, it is able to write in data at a compensation stage of each display period, and compensate for an IR drop (the IR drop refers to such a phenomenon where a voltage across a power source and the ground in an IC decreases or increases) and a threshold voltage of the driving transistor M1, and automatically reset a voltage applied to the first end of the storage capacitor unit 11 (i.e., a potential at the gate electrode of the driving transistor M1) to a resetting voltage, i.e., it is able to perform a resetting operation, a data write-in operation and a compensation operation at one stage, thereby to improve a processing speed of the pixel circuit. At a light-emitting stage, the pixel circuit is merely adopted for driving a pixel to emit light without any other processings, so it is able for the pixel to emit light in a more stable manner. In addition, it is able to simplify the structure of the pixel circuit, thereby to improve the yield as well as a pixel density.

In actual use, the current supply unit 20 may be a current source for supplying the data current $I_{data}$.

In a possible embodiment of the present disclosure, the driving transistor may be a p-type transistor, the first voltage input end may be a high voltage input end, and the second voltage input end may be a low voltage input end.

In another possible embodiment of the present disclosure, the driving transistor may be an n-type transistor, the first voltage input end may be a low voltage input end, and the second voltage input end may be a high voltage input end.

In a possible embodiment of the present disclosure, the compensation unit 12 may include: a first compensation transistor, a gate electrode of which is connected to the compensation control end Re, a first electrode of which is connected to the gate electrode of the driving transistor M1, and a second electrode of which is connected to the current supply unit 20; and a second compensation transistor, a gate electrode of which is connected to the compensation control end Re, a first electrode of which is connected to the gate electrode of the driving transistor M1, and a second electrode of which is connected to the second electrode of the driving transistor M1.

In a possible embodiment of the present disclosure, the first compensation transistor and the second compensation transistor may both be n-type transistors, or p-type transistors.

In a possible embodiment of the present disclosure, the switching unit 13 may include a switching transistor, a gate electrode of which is connected to the light-emitting control end EM, a first electrode of which is connected to the second electrode of the driving transistor M1, and a second electrode of which is connected to the first end of the light-emitting element EL.

In actual use, the switching transistor may be an n-type or a p-type transistor.

In a possible embodiment of the present disclosure, the storage capacitor unit 11 may include a storage capacitor, a first end of which is connected to the gate electrode of the driving transistor M1, and a second end of which is connected to the first voltage input end VI1.

In a possible embodiment of the present disclosure, the light-emitting element EL may include an OLED. The driving transistor may be a p-type transistor, the first end of the light-emitting element EL may be an anode of the OLED, and the second end of the light-emitting element EL may be a cathode of the OLED; or the driving transistor may be an n-type transistor, the first end of the light-emitting element may be a cathode of the OLED, and the second end of the light-emitting element may be an anode of the OLED.

Figure 2:
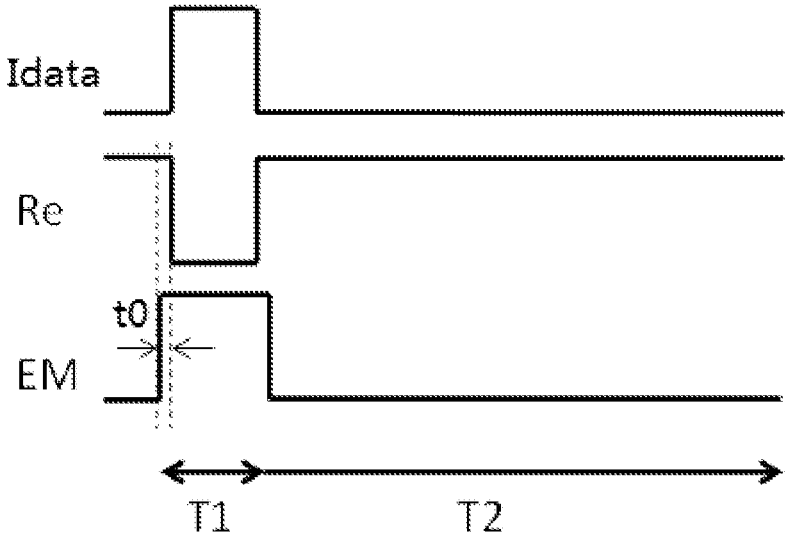
FIG. 2 is a time sequence diagram of the pixel circuit according to some embodiments of the present disclosure.

FIG. 2 is a sequence diagram of the pixel circuit in FIG. 1. During the operation of the pixel circuit, at the compensation stage T1 of each display period, the light-emitting control end EM may output a high level, and the compensation control end Re may output a low level. It should be appreciated that, in FIG. 2, the switching transistor included in the switching unit 13 may be a p-type transistor, and the first and second compensation transistors included in the compensation unit 12 may both be p-type transistors. In actual use, when the switching transistor is an n-type transistor, it is necessary to change a potential of the signal from the light-emitting control end EM, and when the first and second compensation transistors are both n-type transistors, it is necessary to change a potential of the signal from the compensation control end Re, and under the control of the high level from the light-emitting control end EM, the switching unit 13 may control the second electrode of the driving transistor M1 to be electrically disconnected from the first end of the light-emitting element EL. Under the control of the low level from the compensation control end Re, the compensation unit 12 may control the current supply unit 20 to supply the data current $I_{data}$ to the gate electrode and the second electrode of the driving transistor M1, so as to enable a driving current I of the M1 in a stable state to be equal to the data current $I_{data}$ and enable the potential at the gate electrode of the driving transistor M1 to be set as the resetting voltage, thereby to enable a current flowing through the driving transistor M1 to be independent of a threshold voltage of the driving transistor M1 and a first voltage from the first voltage input end VI1.

At the light-emitting stage T2 of each display period, the light-emitting control end EM may output a low level, and the compensation control end Re may output a high level. It should be appreciated that, the switching transistor included in the switching unit 13 may be a p-type transistor, and the first and second compensation transistors included in the compensation unit 12 may both be p-type transistors. In actual use, when the switching transistor is an n-type transistor, it is necessary to change a potential of the signal from the light-emitting control end EM, and when the first and second compensation transistors are both n-type transistors, it is necessary to change a potential of the signal from the compensation control end Re. Under the control of the low level from the light-emitting control end EM, the switching unit 13 may control the second electrode of the driving transistor M1 to be electrically connected to the first end of the light-emitting element EL, and under the control of the high level from the compensation control end Re, the compensation unit 12 may control the current supply unit 20 to be electrically disconnected from the gate electrode and the second electrode of the driving transistor M1, so as to maintain the potential at the gate electrode of the driving transistor M1 at the resetting voltage, thereby to control the driving transistor M1 to operate in a saturated state. At this time, the current flowing through the driving transistor M1 may be independent of the threshold voltage of the driving transistor M1 and the first voltage from the first voltage input end VI1, and the driving current of the driving transistor M1 may be equal to $I_{data}$.

During the implementation, after the current compensation at the compensation stage T1, and at the light-emitting stage T2, the driving current of the driving transistor M1 may be equal to $I_{data}$, i.e., it may be independent of the threshold voltage of the driving transistor M1 and the first voltage from the first voltage input end VI1.

In actual use, when the driving transistor M1 is a p-type transistor and the first voltage input end VI1 is a high voltage input end for inputting a high voltage VDD, at the compensation stage T1 and the light-emitting stage T2, the driving current I of the driving transistor M1 may be equal to $K(Vgs-Vth)^2$, where Vgs represents a gate-to-source voltage of the driving transistor M1. In addition, Vgs=Vg−VDD, i.e., $I_{data}=K(Vg-VDD-Vth)^2$, where Vth represents the threshold voltage of the driving transistor M1, and Vg represents a voltage applied to the gate electrode of the driving transistor M1. After the current compensation, $Vg=VDD+V_{th}+\sqrt{I_{data}/K}$, i.e., the resetting voltage may be equal to $VDD+V_{th}+\sqrt{I_{data}/K}$, where K represents a current coefficient of the driving transistor and $$K = \frac{W}{2L}\mu C_{OX},$$

W/L represents an aspect ratio of the driving transistor M1, μ represents hole mobility, and Cox represents a capacitance of the gate electrode of the driving transistor.

The pixel circuit in the embodiments of the present disclosure may be a current compensation pixel circuit. Through the current compensation, it is able to compensate for the threshold voltage and the IR drop, and enable an on-state voltage of the driving transistor M1 to be in a stable state, thereby to prevent a luminance of the light-emitting element EL from being adversely affected due to the instable threshold voltage of the driving transistor M1 and the IR drop, and improve the brightness evenness of a display device.

According to the pixel circuit in the embodiments of the present disclosure, it is able to, at the compensation stage, perform the data write-in operation, the compensation of the IR drop and the compensation of the threshold voltage of the driving transistor, and automatically set the voltage applied to the first end of the storage capacitor unit (i.e., the potential at the gate electrode of the driving transistor) to the resetting voltage, i.e., to perform the resetting operation, the data write-in operation and the compensation operation at one stage, thereby to increase the processing speed of the pixel circuit. In addition, at the light-emitting stage, the pixel circuit may merely drive the pixel to emit light without any other processings, so it is able for the pixel to emit light in a stable manner.

In a possible embodiment of the present disclosure, when the driving transistor is a p-type transistor and the first voltage input end is a high voltage input end for inputting a high voltage VDD, the resetting voltage may be equal to $VDD+V_{th}-\sqrt{I_{data}/K}$, where Vth represents the threshold voltage of the driving transistor, and K represents the current coefficient of the driving transistor.

In another possible embodiment of the present disclosure, when the driving transistor is an n-type transistor and the first voltage input end is a low voltage input end for inputting a low voltage VSS, the resetting voltage may be equal to $VSS+V_{th}+\sqrt{I_{data}/K}$, where Vth represents the threshold voltage of the driving transistor, and K represents the current coefficient of the driving transistor.

As shown in FIG. 2, during the operation of the pixel circuit, at the compensation stage T1, the switching unit 13 may control the second electrode of the driving transistor M1 to be electrically disconnected from the first end of the light-emitting element EL under the control of the light-emitting control end EM. After the elapse of a predetermined time period t0, the compensation unit 12 may control the current supply unit 20 to supply the data current $I_{data}$ to the gate electrode and the second electrode of the driving transistor M1 under the control of the compensation control end Re.

Based on the time sequence diagram in FIG. 2, a rising edge of the signal from the light-emitting control end EM may be spaced apart from a falling edge of the signal from the compensation control end Re by the predetermined time period t0, so as to prevent the first and second compensation transistors included in the compensation unit 12 and the switching transistor included in the switching unit 13 from being turned on simultaneously, thereby to prevent the occurrence of misoperation.

The pixel circuit will be described hereinafter in conjunction with FIGS. 3 and 4.

Figure 3:
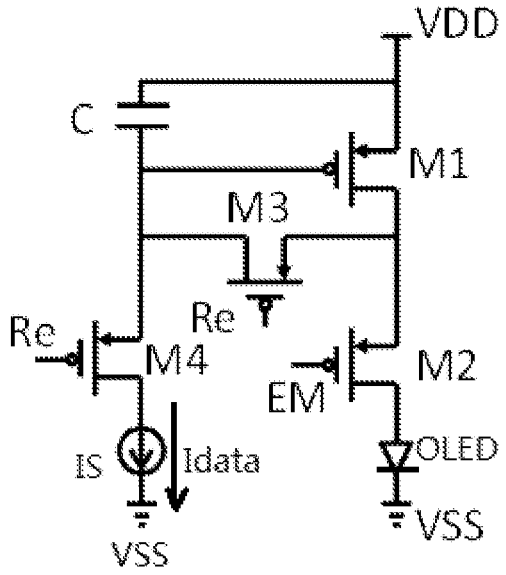
FIG. 3 is a circuit diagram of the pixel circuit according to some embodiments of the present disclosure.

As shown in FIG. 3 which is a circuit diagram of the pixel circuit, the pixel circuit may include a storage capacitor C, the driving transistor M1, the compensation unit, the switching unit, the OLED and the current source IS.

A first end of the storage capacitor C may be connected to the gate electrode of the driving transistor M1, and a second end thereof may be connected to the high voltage input end for inputting the high voltage VDD. A source electrode of the driving transistor M1 may be connected to the high voltage input end for inputting the high voltage VDD.

The compensation unit may include: a first compensation transistor M4, a gate electrode of which is connected to the compensation control end Re, a source electrode of which is connected to the gate electrode of the driving transistor M1, and a drain electrode of which is connected to the current source IS for supplying the data current $I_{data}$; and a second compensation transistor M3, a gate electrode of which is connected to the compensation control end Re, a source electrode of which is connected to the drain electrode of the driving transistor M1, and a drain electrode of which is connected to the gate electrode of the driving transistor M1.

The switching unit may include a switching transistor M2, a gate electrode of which is connected to the light-emitting control end EM, a source electrode of which is connected to the drain electrode of the driving transistor M1, and a drain electrode of which is connected to an anode of the OLED. A cathode of the OLED may be connected to the low voltage input end for inputting the low voltage VSS.

In FIG. 3, the switching transistor M2, the driving transistor M1, the first compensation transistor M4 and the second compensation transistor M3 may all be p-type transistors.

As shown in FIG. 3 in conjunction with FIG. 2, during the operation of the pixel circuit, at the compensation stage T1, the compensation control end Re may output a low level, and the light-emitting control end EM may output a high level. At this time, M3 and M4 may be both in an on state, and M2 may be in an off state. Due to $I_{data}$, a voltage applied to a first polar plate of the storage capacitor C (i.e., the first end of the storage capacitor C) may be changed. For the driving current I, $I=K(Vgs-Vth)^2$, where K represents the current coefficient of M1, Vgs represents the gate-to-source voltage of M1, Vth represents the threshold voltage of M1, and Vgs=Vg−VDD. The critical condition for the driving transistor M1 being in a stable state is that the driving current I of M1 is equal to the data current $I_{data}$, i.e., $I_{data}=K(Vg-VDD-Vth)^2$. Hence, after the compensation, the gate voltage of M1 is that $Vg=VDD+V_{th}+\sqrt{I_{data}/K}$. At the light-emitting stage T2, the compensation control end Re may output a high level, and the light-emitting control end EM may output a low level. At this time, M1 and M2 may be both in the on state, M3 and M4 may be both in the off state, and the driving current of M1 is that $I=K(VDD+Vth-\sqrt{I_{data}/K}-VDD-Vth)^2=I_{data}$. Hence, the data current $I_{data}$ may be written into the storage capacitor C, so as to generate a current, which is the same as the data current and independent of VDD and Vth, thereby to drive the OLED to emit light.

In the embodiments of the present disclosure, the pixel circuit may be automatically reset. When the voltage applied to the first polar plate of the storage capacitor C (i.e., the first end of the storage capacitor C) is greater than the voltage applied to the gate electrode of M1, charges at the first polar plate of the storage capacitor C may be released, so as to reduce the voltage applied to the gate electrode of M1 until the driving current I is equal to $I_{data}$. When the voltage applied to the first polar plate of the storage capacitor C is smaller than the voltage applied to the gate electrode of M1 required by applying the data current $I_{data}$, the driving current of M1 may be greater than $I_{data}$, so a part of the driving current may serve as $I_{data}$, and the other part of the driving current may be used to charge the storage capacitor C until the voltage applied to the first polar plate of the storage capacitor C is sufficiently high to enable the driving current of M1 is equal to $I_{data}$.

During the operation of the pixel circuit, through simulation, when $I_{data}$ is 1 μA, 2 μA or 3 μA, the driving current I of M1 (i.e., the driving current of the OLED) may be equal to $I_{data}$, which has fully demonstrated the feasibility of the pixel circuit in the embodiments of the present disclosure.

Figure 4:
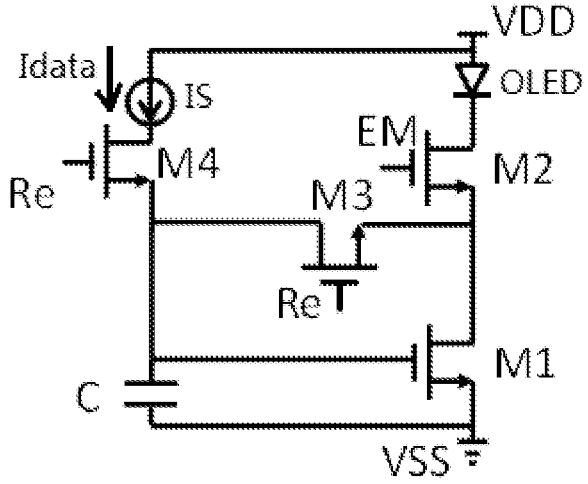
FIG. 4 is another circuit diagram of the pixel circuit according to some embodiments of the present disclosure.

As shown in FIG. 4 which is another circuit diagram of the pixel circuit, the pixel circuit may include a storage capacitor C, the driving transistor M1, the compensation unit, the switching unit, the OLED and the current source IS.

A first end of the storage capacitor C may be connected to the gate electrode of the driving transistor M1, and a second end thereof may be connected to the low voltage input end for inputting the low voltage VSS. A source electrode of the driving transistor M1 may be connected to the low voltage input end for inputting the low voltage VSS.

The compensation unit may include: a first compensation transistor M4, a gate electrode of which is connected to the compensation control end Re, a source electrode of which is connected to the gate electrode of the driving transistor M1, and a drain electrode of which is connected to the current source IS; and a second compensation transistor M3, a gate electrode of which is connected to the compensation control end Re, a source electrode of which is connected to the drain electrode of the driving transistor M1, and a drain electrode of which is connected to the gate electrode of the driving transistor M1.

The switching unit may include a switching transistor M2, a gate electrode of which is connected to the light-emitting control end EM, a source electrode of which is connected to the drain electrode of the driving transistor M1, and a drain electrode of which is connected to a cathode of the OLED. An anode of the OLED may be connected to the high voltage input end for inputting the high voltage VDD.

In FIG. 4, all the transistors may be n-type transistors.

The present disclosure further provides in some embodiments a method for driving the above-mentioned pixel circuit, which includes: at a compensation stage of each display period, controlling, by the switching unit, the second electrode of the driving transistor to be electrically disconnected from the first end of the light-emitting element under the control of the light-emitting control end, controlling, by the compensation unit, the current supply unit to supply a data current $I_{data}$ to the gate electrode and the second electrode of the driving transistor under the control of the compensation control end, so as to enable a driving current of the driving transistor to be equal to the data current $I_{data}$, and set a potential at the gate electrode of the driving transistor to be a resetting voltage, thereby to enable the current flowing through the driving transistor (i.e., the driving current of the driving transistor) to be independent of the threshold voltage of the driving transistor and the first voltage from the first voltage input end; and at a light-emitting stage of each display period, controlling, by the switching unit, the second electrode of the driving transistor to be electrically connected to the first end of the light-emitting element under the control of the light-emitting control end, and controlling, by the compensation unit, the current supply unit to be electrically disconnected from the gate electrode and the second electrode of the driving transistor under the control of the compensation control end, so as to maintain a potential at the gate electrode of the driving transistor as the resetting voltage, thereby to control the driving current of the driving transistor to be equal to the data current $I_{data}$, and enable the current flowing through the driving transistor (i.e., the driving current of the driving transistor) to be independent of the threshold voltage of the driving transistor and the first voltage from the first voltage input end.

According to the driving method in the embodiments of the present disclosure, it is able to, at the compensation stage, perform the data write-in operation, the compensation of the IR drop and the compensation of the threshold voltage of the driving transistor, and automatically set the voltage applied to the first end of the storage capacitor unit (i.e., the potential at the gate electrode of the driving transistor) to the resetting voltage, i.e., to perform the resetting operation, the data write-in operation and the compensation operation at one stage, thereby to increase the processing speed of the pixel circuit. In addition, at the light-emitting stage, the pixel circuit may merely drive the pixel to emit light without any other processings, so it is able for the pixel to emit light in a stable manner.

In a possible embodiment of the present disclosure, when the driving transistor is a p-type transistor and the first voltage input end is a high voltage input end for inputting a high voltage VDD, the resetting voltage may be equal to $VDD+V_{th}-\sqrt{I_{data}/K}$, where Vth represents the threshold voltage of the driving transistor, and K represents the current coefficient of the driving transistor.

In another possible embodiment of the present disclosure, when the driving transistor is an n-type transistor and the first voltage input end is a low voltage input end for inputting a low voltage VSS, the resetting voltage may be equal to $VSS+V_{th}+\sqrt{I_{data}/K}$, where Vth represents the threshold voltage of the driving transistor, and K represents the current coefficient of the driving transistor.

In a possible embodiment of the present disclosure, the method may further include, at the compensation stage: controlling, by the switching unit, the second electrode of the driving transistor to be electrically disconnected from the first end of the light-emitting element under the control of the light-emitting control end; and after the elapse of a predetermined time period, controlling, by the compensation unit, the current supply unit to supply the data current $I_{data}$ to the gate electrode and the second electrode of the driving transistor under the control of the compensation control end.

Through the predetermined time period, it is able to prevent the first and second compensation transistors included in the compensation unit and the switching transistor included in the switching unit from being turned on simultaneously, thereby to prevent the occurrence of misoperation.

The present disclosure further provides in some embodiments a display device including the above-mentioned pixel circuit. The display device may be any product or member having a display function, e.g., mobile phone, flat-panel computer, television, display, laptop computer, digital photo frame or navigator.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A method for driving a pixel circuit, the pixel circuit comprises a storage capacitor unit, a driving transistor, a compensation unit, a switching unit, a light-emitting element and a current supply unit configured to supply a data current, wherein a first end of the storage capacitor unit is connected to a gate electrode of the driving transistor, and a second end of the storage capacitor unit is connected to a first voltage input end;

a first electrode of the driving transistor is connected to the first voltage input end;

the compensation unit is connected to a compensation control end, the gate electrode and a second electrode of the driving transistor, and the current supply unit, and configured to, under the control of the compensation control end, control the current supply unit to be electrically connected to, or electrically disconnected from, the gate electrode of the driving transistor, and control the gate electrode of the driving transistor to be electrically connected to, or electrically disconnected from, the second electrode of the driving transistor;

the switching unit is connected to a light-emitting control end, the second electrode of the driving transistor and a first end of the light-emitting element, and configured to control the second electrode of the driving transistor to be electrically connected to, or electrically disconnected from, the first end of the light-emitting element under the control of the light-emitting control end; and a second end of the light-emitting element is connected to a second voltage input end, the method comprises:

at a compensation stage of each display period, controlling, by the switching unit, the second electrode of the driving transistor to be electrically disconnected from the first end of the light-emitting element under the control of the light-emitting control end, controlling, by the compensation unit, the current supply unit to supply a data current $I_{data}$ to the gate electrode and the second electrode of the driving transistor under the control of the compensation control end, to enable the driving transistor to operate in a saturated state, enable a driving current of the driving transistor to be equal to the data current $I_{data}$, and set a potential at the gate electrode of the driving transistor to be a resetting voltage; and at a light-emitting stage of each display period, controlling, by the switching unit, the second electrode of the driving transistor to be electrically connected to the first end of the light-emitting element under the control of the light-emitting control end, and controlling, by the compensation unit, the current supply unit to be electrically disconnected from the second electrode of the driving transistor under the control of the compensation control end, to maintain a potential at the gate electrode of the driving transistor as the resetting voltage, thereby to control the driving transistor to operate in a saturated state and enable the driving current of the driving transistor to be equal to the data current $I_{data}$.

2. The method according to claim 1, wherein the driving transistor is a p-type transistor and the first voltage input end is a high voltage input end for inputting a high voltage VDD, the resetting voltage is equal to $VDD+V_{th}-\sqrt{I_{data}/K}$, where Vth represents a threshold voltage of the driving transistor, and K represents a current coefficient of the driving transistor.

3. The method according to claim 1, wherein the driving transistor is an n-type transistor and the first voltage input end is a low voltage input end for inputting a low voltage VSS, the resetting voltage is equal to $VSS+V_{th}+\sqrt{I_{data}/K}$, wherein Vth represents a threshold voltage of the driving transistor, and K represents a current coefficient of the driving transistor.

4. The method according to claim 1, further comprising, at the compensation stage:

controlling, by the switching unit, the second electrode of the driving transistor to be electrically disconnected from the first end of the light-emitting element under the control of the light-emitting control end; and after the elapse of a predetermined time period, controlling, by the compensation unit, the current supply unit to supply the data current $I_{data}$ to the gate electrode and the second electrode of the driving transistor under the control of the compensation control end.

5. The method according to claim 4, wherein at the compensation stage, a high level signal is outputted by the light-emitting control end, a low level signal is outputted by the compensation control end, a rising edge of the signal from the light-emitting control end is spaced apart from a falling edge of the signal from the compensation control end by the predetermined time period; or a low level signal is outputted from the light-emitting control end, a high level signal is outputted by the compensation control end, and a falling edge of the signal from the light-emitting control end is spaced apart from a rising edge of the signal from the compensation control end by the predetermined time period.

* * * * *